United States Patent [19]

Imai

[11] 4,329,547

[45] May 11, 1982

[54] DUAL SECTION ELECTRET MICROPHONE

[75] Inventor: Tsutomu Imai, Tokyo, Japan

[73] Assignee: Sony Corporation, Tokyo, Japan

[21] Appl. No.: 126,380

[22] Filed: Mar. 3, 1980

[30] Foreign Application Priority Data

Mar. 8, 1979 [JP] Japan ..... 54-27109

[51] Int. Cl.[3] ..... H04R 19/04

[52] U.S. Cl. ..... 179/111 E; 179/121 D

[58] Field of Search ..... 179/1 DM, 111 E, 121 D

[56] References Cited

U.S. PATENT DOCUMENTS

| | | | |
|---|---|---|---|
| Re. 28,420 | 5/1975 | Murphy | 179/111 E |
| 3,980,838 | 9/1976 | Yakushij et al. | 179/111 E |
| 4,041,446 | 8/1977 | Liebermann | 179/111 E |
| 4,246,448 | 1/1981 | Tam et al. | 179/111 E |

FOREIGN PATENT DOCUMENTS

| | | | |
|---|---|---|---|
| 2738978 | 3/1979 | Fed. Rep. of Germany | 179/1 DM |

*Primary Examiner*—George G. Stellar

*Attorney, Agent, or Firm*—Lewis H. Eslinger; Alvin Sinderbrand

[57] ABSTRACT

A bi-directional capacitor microphone is formed of first and second transducer sections, each section comprising a diaphragm and a back plate facing the diaphragm and separated therefrom. The diaphragm of the first transducer section includes an electret and the back plate of the second transducer section includes another electret. The back plates of the first and second transducer sections are disposed in a back-to-back configuration and are electrically coupled to each other and to one output. The diaphragms of the first and second transducer sections are connected to each other and to another output, so that an output signal appears between the outputs. Preferably, both electrets are selected to have a negative polarity. The bi-directional microphone so constructed exhibits superior response for lower audio frequencies.

7 Claims, 5 Drawing Figures

DUAL SECTION ELECTRET MICROPHONE

BACKGROUND OF THE INVENTION

1. Field of the Invention

This invention relates generally to a capacitor microphone, and is directed more particularly to a bi-directional capacitor microphone having a pair of back-to-back transducer sections.

2. Description of the Prior Art

In general, a conventional bi-directional capacitor microphone is formed of a pair of conductive back plates and a conductive diaphragm disposed between the back plates with predetermined air gaps separating it from the back plates. In particular a first transducer section is formed of a first perforated back plate and a diaphragm spaced a predetermined amount from the first back plate, and a second transducer section is formed of a second perforated back plate and spaced another predetermined amount from the diaphragm. In such a microphone, the first and second back plates are positioned either to the left and right or above and below the diaphragm, and are electrically connected to each other. An electret layer is coated on the surfaces of both back plates that face the diaphragm. Thus, an electric charge is applied to the back plates so that vibrations of the diaphragm will induce an electric signal between the back plates and the diaphragm.

The conventional microphone described above can be provided with a bi-directional characteristic by selecting the electret of the first transducer section and the electret of the second transducer section to have opposite polarities.

Although the above microphone has a bi-directional characteristic, its frequency characteristic for low frequencies is rather poor. The reason for this is that the diaphragm is common to both the transducer sections, and the lower frequency sound waves of arrive virtually simultaneously at both surfaces of the diagram with almost no phase difference imparted to the two surfaces of the diaphragm, as a result, the diaphragm is not vibrated.

Another drawback of the above microphone is that unless the distance from the diaphragm to each back plate, that is, the width of each of the air gaps, is selected equal to the other, the characteristics of the respective transducer sections are not matched. This matching of characteristics is very difficult work in the microphones according to the prior art.

OBJECTS AND SUMMARY OF THE INVENTION

Accordingly, an object of the present invention is to provide a novel capacitor microphone which uses two transducer sections and avoids the drawbacks inherent in the prior art.

Another object of the invention is to provide a capacitor microphone in which a first transducer section having a diaphragm made of an electret and a second transducer section having a back plate with an electret are combined to provide the microphone with a superior bi-directional characteristic.

A further object of the invention is to provide a capacitor microphone which is simple in construction and superior in directional characteristic.

A further object of the invention is to provide a capacitor microphone in which left and right directional characteristics are both equal.

A yet further object of the invention is to provide a capacitor microphone in which the assembling of a diaphragm and a back plate can be performed simply.

A still further object of the invention is to provide a capacitor microphone whose directional characteristic is not changed even if it is used for a long time.

According to an aspect of the invention, a capacitor microphone comprises a first diaphragm including a first electret; a first conductive back plate having a surface facing the first diaphragm and spaced apart therefrom; a second conductive back plate electrically coupled to the first conductive back plate; a second electret on one surface of the second conductive back plate; a second diaphragm at least partially of conductive material facing the one surface of the second conductive back plate and spaced apart therefrom; and first and second output electrodes. The diaphragms are coupled to each other and to the first output electrode, while the back plates are coupled to each other and to the second output electrode, so that an output signal appears between the first and second output electrodes. Preferably, the back plates are disposed in a parallel, back-to-back configuration, and the electrets each have a negative polarity.

The above and other objects, features and advantages of the present invention will become apparent from the following description taken in conjunction with the accompanying drawings in which like reference numerals identify the same elements and parts.

DESCRIPTION OF THE PREFERRED EMBODIMENTS

In the embodiment of the invention shown in FIG. 1, a capacitor microphone 1 is formed of first and second audio-electric transducing members (which will be hereinafter referred simply to as transducer sections) 1*a* and 1*b*. The first transducer section 1*a* comprises a diaphragm 2*a* and a back plate 3*a* which is made of a conductor and has a number of perforations or sound openings 4*a*. The back plate 3*a* faces the diaphragm 2*a* and is separated therefrom by a spacer 6*a* made of an insulator. The second transducer section 1*b* comprises a diaphragm 2*b* and a back plate 3*b* which is made of a conductor and has a number of performations or sound openings 4*b* and faces the diaphragm 2*b* and is separated therfrom by a spacer 6*b* made of an insulator. In this embodiment, the diaphragm 2*a* of the first transducer section 1*a* is made of an electret, and the diaphragm 2*b* of the second transducer section 1*b* is formed of a thin diaphragm material such as a thin conductive metal plate or thin synthetic resin layer with conductive material deposited thereon by vaporization. An electret 5 having apertures 4*b*′ matching the sound openings 4*b* of the back plate 3*b* is coated on the surface of the back plate 3*b* facing the diaphragm 2*b*. The diaphragm 2*a* is provided with a conductive surface, which can be formed by vapor deposition. In other words, in the first transducer section 1*a*, the diaphragm 2*a* itself is formed as the electret, while in the second transducer section 1*b*, the back plate 3*b* includes the electret 5.

Figure 1:
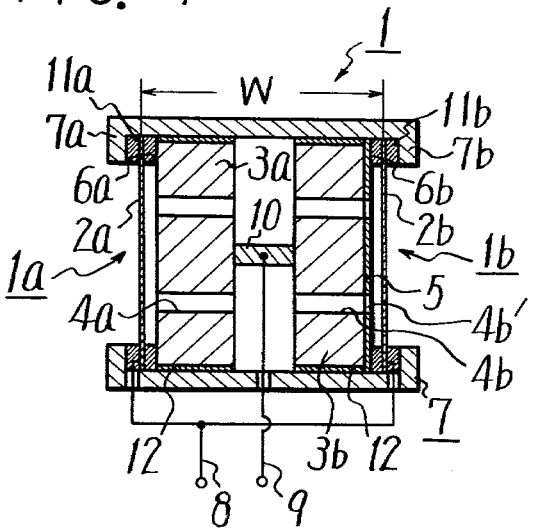
FIG. 1 is a schematic cross-sectional view showing a capacitor microphone according to an embodiment the present invention.

In the embodiment of FIG. 1, the electrets are arranged so that their surfaces facing the back plates 3*a* and 3*b* are of like polarity. Further, it may be desired that negative charge is used as the charge imparted by the electrets. The back plates 3*a* and 3*b* are electrically coupled by a conductive bar 10. Both of the first and second transducer sections 1*a* and 1*b* are covered by a housing 7 made of, for example, aluminium. The housing 7 comprises peripheral portions 7*a* and 7*b* which press against conductive rings 11*a* and 11*b* to bias the diaphragms 2*a* and 2*b* towards the back plates 3*a* and 3*b*, respectively. Insulating layers 12 are provided between the housing 7 and the back plates 3*a* and 3*b*. The diaphragms 2*a* and 2*b* are electrically connected to one another and to a first lead 8, and the conductive bar 10, which couples the back plates 3*a* and 3*b*, is connected to a second lead 9. Any conventional, well-known electret can be used as the diaphragm 2*a* and the electret 5.

Figure 2A:
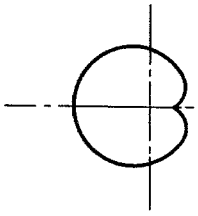
FIGS. 2A and 2B are graphs showing directional characteristics of first and second transducer sections of, respectively, the microphone shown in FIG. 1.
Figure 2B:
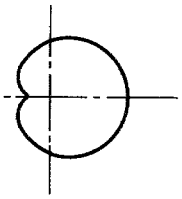
Figure 3:
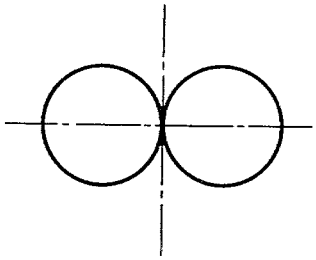
FIG. 3 is a graph showing the directional characteristic of the microphone shown in FIG. 1.

With to the capacitor microphone of the present invention constructed as above, since the diaphragm 2*a* of the first transducer section 1*a* contains negative charge, the first transducer section 1*a* exhibits cardioid directional characteristic which has a maximum response at the left side as shown in FIG. 2A. Since the electret 5 on the back plate 3*b* in the second transducer section 1*b* is also negatively charged, the second transducer section 1*b* exhibits a cardioid directional characteristic which has a maximum response at the right side as shown in FIG. 2B. Since the two directional characteristics have maximum response directions that are different by 180°, the combined outputs therefrom, which appear at the leads 8 and 9, will exhibit the bi-directional characteristic shown in FIG. 3.

In the embodiment of the invention shown in FIG. 1, the diaphragms 2*a* and 2*b* are located outside the back plates 3*a* and 3*b*, respectively, so that a distance W between the diaphragms 2*a* and 2*b* may be suitably selected, for example, to be 12 mm, for providing a sufficient phase difference between both the diaphragms 2*a* and 2*b* for low frequency sound waves as compared with the prior art microphone, so that the low frequency characteristic according to the microphone of this invention is improved.

Further, by using the electrets of like charge as the diaphragm 2*a* and the electret 5 on the back plate 3*b*, the outputs of the same characteristic can be derived from both the transducer sections. Also, when the charge on the electret is selected to be negative, the charge holding time can be made long as compared with an electret of positive charge. As a result, the microphone of this invention can be used for an extended period of time.

If, in the second transducer section 1*b*, the diaphragm 2*b* is made of an electret diaphragm, and hence the electret 5 on the back plate 3*b* is removed, then, the electret diaphragm must be selected to have a different polarity from the electret in the first transducer section 1*a*. For example, when a negatively-charged electret is used as one of the diaphragms, for example, diaphragm 2*a*, and a positively-charged electret is used as the other diaphragm 2*b*, the charge in the electret that is charged positively becomes greatly attenuated over an extended period, as compared with the electret which is charged negatively. As a result, the outputs from both the transducer sections become different. In other words, such a microphone will not provide the desired bi-directional characteristic for any great length of time.

According to this invention, the above defects can be avoided by use of the preferred construction as described above.

Figure 4:
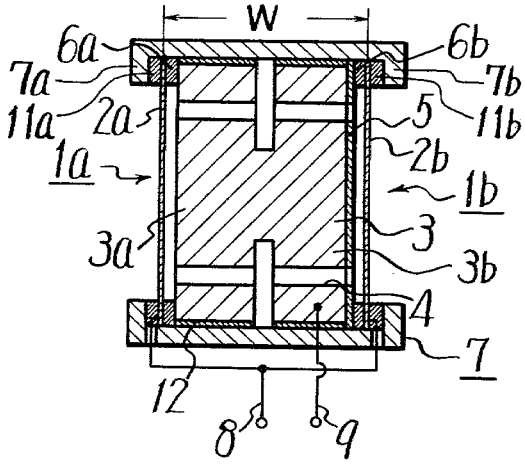
FIG. 4 is a schematic cross-sectional view showing a capacitor microphone according to another embodiment of the invention.

FIG. 4 shows another embodiment of the capacitor microphone according to the present invention. In this embodiment, a single back plate or block 3 with openings 4 is made by form the back plates 3*a* and 3*b* of FIG. 1 as an integrated unit, while the remaining construction and operation of this embodiment are substantially the same as in the embodiment shown in FIG. 1. Therefore, in FIG. 3 the parts and elements corresponding to those shown in FIG. 1 are identified with the same reference numerals, and their detailed description is omitted.

It will be apparent that many modifications and variations could be effected by one skilled in the art without departing from the spirit or scope of the present invention which is intended to be defined by the appended claims.

I claim as my invention:

1. A capacitor microphone comprising
   - a first transducer section including a conductive back plate portion and a diaphragm, the latter being formed, at least partially, of a first electret;
   - a second transducer section including a conductive diaphragm and a back plate portion, the latter being formed, at least partially, of a second electret;
   - a first lead connected to the diaphragms of said first and second transducer sections; and
   - a second lead connected to the back plate portions of said first and second transducer sections, so that an output signal appears between said first and second leads.

2. A capacitor microphone comprising
   - a first diaphragm including a first electret;
   - a first conductive back plate portion having a surface facing said first diaphragm and spaced apart therefrom;
   - a second conductive back plate portion electrically coupled to said first conductive back plate portion;
   - a second electret on one surface of said second conductive back plate portion;
   - a second diaphragm at least partially of conductive material and facing said one surface of said second conductive back plate portion in spaced apart relation thereto;
   - first and second outputs;
   - means electrically coupling said first and second diaphragms to one another and to said first output; and
   - means electrically coupling said first and second back plate portions to said second output.

3. A capacitor microphone according to claim 2, wherein said first and second back plate portions are formed of a single, integrated block.

4. A capacitor microphone according to claim 2, wherein said first and second conductive back plate portions are disposed in parallel, back-to-back relation so that the microphone has a bi-directional characteristic.

5. A capacitor microphone according to claim 4, wherein said first and second electrets have like electric polarity.

6. A capacitor microphone according to claim 5, wherein said first and second electrets have negative polarity.

7. A capacitor microphone according to claim 5, wherein said first and second back plate portions are formed of a single, integrated block.

* * * * *